US009313566B2

(12) United States Patent
Sakurai et al.

(10) Patent No.: US 9,313,566 B2
(45) Date of Patent: Apr. 12, 2016

(54) ACOUSTIC EQUIPMENT

(71) Applicant: Yamaha Corporation, Hamamatsu-shi (JP)

(72) Inventors: Yuuji Sakurai, Hamamatsu (JP); Tsutomu Watanabe, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/370,746

(22) PCT Filed: Dec. 28, 2012

(86) PCT No.: PCT/JP2012/084237

§ 371 (c)(1),
(2) Date: Jul. 3, 2014

(87) PCT Pub. No.: WO2013/103145

PCT Pub. Date: Jul. 11, 2013

(65) Prior Publication Data

US 2015/0144420 A1 May 28, 2015

(30) Foreign Application Priority Data

Jan. 6, 2012 (JP) ..... 2012-001251

(51) Int. Cl.
*H04R 1/02* (2006.01)
*H04R 3/00* (2006.01)
*H04R 5/04* (2006.01)

(52) U.S. Cl.
CPC ..... *H04R 1/02* (2013.01); *H04R 1/026* (2013.01); *H04R 3/00* (2013.01); *H04R 5/04* (2013.01)

(58) Field of Classification Search
CPC ..... H04R 2201/02; H04R 2201/025; H04R 2201/401; H04R 1/026; H04R 2205/024; H04R 5/02
USPC ..... 181/199; 381/300, 386, 387, 390; 248/523, 121, 125.8, 176.1
See application file for complete search history.

(56) References Cited

U.S. PATENT DOCUMENTS 2,179,840 A * 11/1939 Bucky ..... 381/334
4,744,690 A * 5/1988 Hsieh ..... 403/104

(Continued)

FOREIGN PATENT DOCUMENTS

| | | | |
|---|---|---|---|
| JP | 57-195289 | U | 12/1982 |
| JP | 61-168785 | U | 10/1986 |
| JP | 05-31487 | U | 4/1993 |
| JP | 10-160094 | A | 6/1998 |
| JP | 4496904 | B2 | 4/2010 |

OTHER PUBLICATIONS

Ultimate Support Systems. "TSM-138MK: Mounting Bracket for Mounting Speaker Cabinets on Speaker Stands—1 ⅜"" <http://web.archive.org/web/20101231205001/http://www.ultimatesupport.com/product/TSM-138MK>, retrieved Dec. 31, 2010 via Internet Archive.*

(Continued)

*Primary Examiner* — Jeremy Luks
(74) *Attorney, Agent, or Firm* — Morrison & Foerster LLP

(57) ABSTRACT

A distal end of an inserted pole makes contact with a bottom surface or tapering surface of a portion corresponding to a bottom of an insertion hole. A lever rotates about a pivot shaft, and a pressing surface facing from a recessed portion formed in the insertion hole presses a side surface portion of the pole. The pole pressed by the pressing surface is mainly received by ridge portions, particularly the ridge portions positioned on the opposite side with a central axis therebetween in relation to the pressing surface. The ridge portions are positioned on both sides of the pole with the cross section along the line A-A therebetween as viewed in the axial direction. As the lever is rotatably operated in the tightening direction, the pressing position gradually approaches the central axis, thereby increasing the pressing force.

9 Claims, 5 Drawing Sheets

(56) References Cited

U.S. PATENT DOCUMENTS

| | | | | |
|---|---|---|---|---|
| 5,918,997 | A * | 7/1999 | Hsieh | 403/104 |
| 5,933,507 | A * | 8/1999 | Woolley et al. | 381/300 |
| 6,035,962 | A * | 3/2000 | Lin | 181/199 |
| 7,961,901 | B2 * | 6/2011 | Konig | 381/390 |
| 2006/0060416 | A1 | 3/2006 | Tashiro | |
| 2011/0240078 | A1 * | 10/2011 | Lenhart et al. | 135/75 |
| 2011/0243363 | A1 * | 10/2011 | Yamaguchi | 381/386 |
| 2011/0255730 | A1 * | 10/2011 | Shibata | 381/395 |

OTHER PUBLICATIONS

International Search Report mailed Feb. 5, 2013, for International Application No. PCT/JP2012/084237, two pages.

European Search Report mailed Jul. 9, 2015, for EP Application No. EP 12864177.6, five pages.

* cited by examiner

ACOUSTIC EQUIPMENT

CROSS-REFERENCE TO RELATED APPLICATIONS

This application is a National Phase application under 35 U.S.C. §371 of International Application No. PCT/JP2012/084237 filed Dec. 28, 2012, which claims the priority benefit of Japanese Patent Application No. 2012-001251 filed Jan. 6, 2012, the contents of which are hereby incorporated by reference in their entireties for all intended purposes.

TECHNICAL FIELD

The present invention relates to acoustic equipment or audio devices, such as a speaker, which can be fixedly mounted on the stand by being detachably attached to a pole of a stand.

BACKGROUND ART

Heretofore, there have been known acoustic equipment or audio devices, such as speakers and mixer apparatus, which are fixed to a pole of a stand. According to the disclosure of Patent Literature 1, for example, a bracket section is provided at the distal end of a stand's pole of a circular columnar shape, two bracket screws provided on a seat of the bracket section are screwed to an audio device, and the bracket section is fixed to the distal end of the pole by means of a wing screw.

PRIOR ART LITERATURE

Patent Literature 1: Japanese Patent No. 4496904

However, with a mounting structure disclosed in Patent Literature 1, it is necessary to first fix the bracket section to the stand's pole, and, additionally, a problem of poor operability would be encountered because the bracket section and the audio device are screwed together at two positions.

SUMMARY OF INVENTION

In view of the foregoing prior art problems, the present invention seeks to provide an improved audio device which can be mounted on a stand with ease.

In order to accomplish the above-mentioned object, the present invention provides an improved audio device (10) detachably attachable to a pole (12) of a stand, which comprises: an abutting section (23, 24) constructed in such a manner that the distal end of the pole abuts against the abutting section when the audio device is attached on the pole; a pressing member (40) constructed to be operable to pivot in tightening and loosening directions, the pressing member having a pressing surface (41*a*) that presses a side surface portion of the pole toward the central axis (C) of the pole as the pressing member is operated to pivot in the tightening direction with the audio device attached to the pole; and a stopping/engaging section (22C-22F, 26, 61, 62) provided opposite from the pressing surface of the pressing member across the central axis, the stopping/engaging section engaging and supporting the pole pressed by the pressing surface. The pressing member is constructed in such a manner that, as the pressing member is operated to pivot (i.e., pivoted) in the tightening direction, a position (P) of the pressing surface pressing a side surface portion of the pole gradually approaches or gets closer to the central axis of the pole so that pressing force applied from the pressing surface increases. Note that the same reference characters as used for various constituent elements of later-described embodiments of the present invention are indicated in parentheses here merely for ease of understanding of the present invention.

According to the present invention, with the acoustic equipment or audio device inserted over and provisionally attached to the pole of the stand, the distal end of the pole abuts against the abutting section of the audio device, where the audio device is supported and provisionally attached to the pole. Then, as the pressing member is operated by a user to pivot in the tightening direction in such a provisionally attached state, the pressing surface of the pressing member presses the side surface portion of the pole in a direction toward the central axis of the pole. At that time, the pole pressed by the pressing surface is supported at its opposite portion from the pressing surface, because the stopping/engaging section is provided opposite from the pressing surface of the pressing member across (i.e., with respect to) the central axis of the pole. Thus, the pole can be firmly sandwiched and grasped between the pressing member, pivoted in the tightening direction, and the stopping/engaging section. Because the pressing member is constructed in such a manner that, as the pressing member is pivoted in the tightening direction, the position of the pressing surface, pressing the side surface portion of the pole, gradually approaches the central axis of the pole so that pressing force applied from the pressing surface increases, the user can start pivoting the pressing member with a relatively small force at an initial tightening stage and then sandwich the pole with a sufficient force at the last tightening stage. As a result, the user can not only perform the audio-device mounting operation in a smooth and reliably manner. Further, because all the user has to do at the time of the audio-device mounting is to insert the audio device over the pole of the stand and operate the pressing member to pivot in the tightening direction, the operations for mounting the audio device on the stand can be performed with an extreme ease. Further, in dismounting the audio device from the stand, the user can do so by just operating the pressing member to pivot in the loosening direction, and, thus, the operations for dismounting the audio device from the stand can also be performed with an extreme ease.

In an embodiment of the present invention, the stopping/engaging section (22C-22F, 26, 61, 62) is constructed to engage the pole, pressed by the pressing surface, at least two portions thereof that are located on opposite sides of an imaginary straight line passing through the pressing surface and the central axis. In this way, the opposite portion of the pole from the side surface portion pressed by the pressing member can be supported in a well-balanced fashion.

An embodiment of the audio device of the present invention further comprises a provisional engaging section (22A, 22H, 27 and 28) that is provided at a position closer to the pressing surface than the stopping/engaging section and along a circumferential direction around the central axis of the pole and that surrounds, in conjunction with the stopping/engaging section, the pole that is in abutting engagement with the abutting section when the pressing section is in a loosened position. The provision of such a provisional engaging section can stabilize the provisional attachment to the pole, thereby further facilitating the operations for mounting the audio device.

An embodiment of the audio device of the present invention further comprises an insertion hole section which the pole is insertable therein and has the abutting section provided on a bottom thereof. The pressing surface faces the interior of the insertion hole section through a recessed portion formed in a part of the insertion hole section, but also the inner surface of the insertion hole section is constructed to function as the stopping/engaging section and the provisional engaging section. With the inner surface of the insertion hole section constructed to function as the stopping/engaging section and the provisional engaging section like this, the present invention can even further simplify the construction. In this case, the inner surface of the insertion hole section may have a ridge portion and a furrow portion arranged in the circumferential direction, of which the ridge portion may function as the stopping/engaging section and the provisional engaging section. In this way, the audio device can be inserted over and removed from the pole with a relatively small friction, but also the pole can be fastened and grasped between the pressing member and the stopping/engaging section reliably with a simplified construction.

In an embodiment of the audio device, the pressing surface is constructed in such a manner that the position of the pressing surface, pressing the side surface portion of the pole, becomes constant halfway through pivoting movement, in the tightening direction, of the pressing member. With such an arrangement, the audio device can be mounted on the stand stably and fixedly.

As an example, in the acoustic equipment or audio device of the present invention, a pivot shaft of the pressing member may extend vertically to, or in a direction intersecting substantially perpendicularly with, the axial direction of the pole. With such an arrangement, the pressing surface of the pressing member acting on the side surface portion of the pole during the tightening operation pivots along the axial direction of the pole, so that appropriate pole-pressing can be achieved. In this case, the pressing surface may have a concavely curved surface portion provided therein, so that the pressing surface can be placed in close pressed contact with a wider outer peripheral side portion of the pole when the pressing member is in the tightened position and thereby contributes to enhanced fixation force. Further, in an embodiment of the present invention, the pressing member has an operating portion (42) disposed on a bottom portion (15) of the audio device and adapted for operation by the user, and a retaining section (33, 34) is provided on the bottom portion and adapted to retain the operating portion when the pressing member is in a loosened position. Such arrangements can prevent the pressing member from undesirably swaying in the loosened position.

DESCRIPTION OF EMBODIMENTS

Hereinbelow, a description will be given about embodiments of the present invention with reference to the accompanying drawings.

Figure 1:
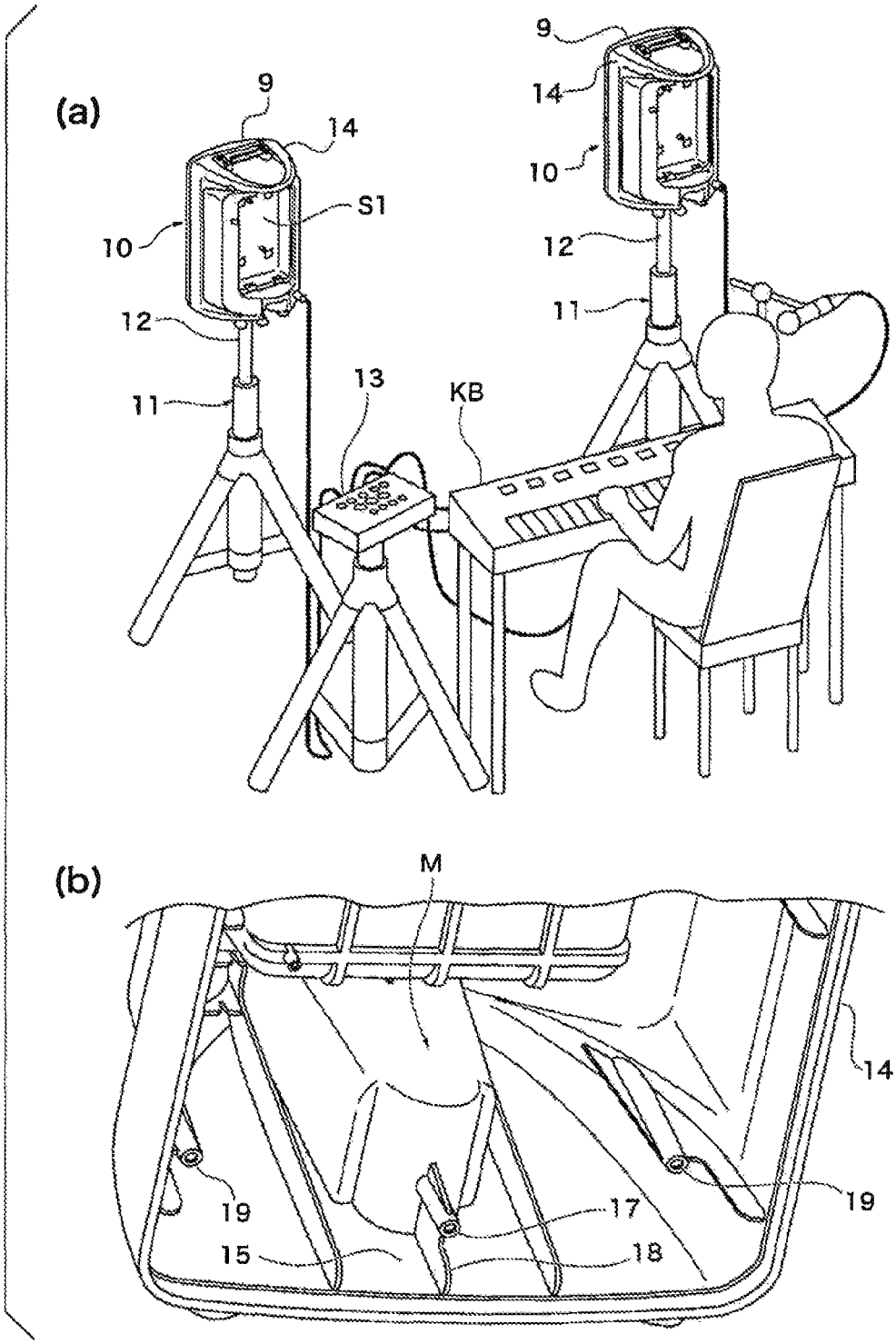
FIG. 1(*a*) is a view Showing an example of a usage state of a speaker set to which acoustic equipment or audio device according to an embodiment of the present invention is applied, and FIG. 1(*b*) is a front perspective view of a lower portion of a casing of a speaker device with a front cover removed.

FIG. 1(*a*) is a view showing an example of a usage state of a speaker set to which acoustic equipment or audio device according to an embodiment of the present invention is applied (a state where the audio device has been mounted on a stand). In the instant embodiment, the audio device is fixedly mounted on the stand 11 by be attached to a pole 12 of a circular columnar pole of the stand 11. Whereas a pair of left and right speaker devices 10 are illustratively shown as the acoustic equipment or audio devices. The basic principles of the present invention are applicable to various other audio devices than speakers, such as a mixer apparatus.

An electronic keyboard musical instrument KB is connected to a mixer apparatus 13, and the speaker devices 10 are connected to the mixer apparatus 13. When not in use, the mixer apparatus 13 can be accommodated in a hollowed section S1 formed in the reverse side of the speaker device 10. The speaker devices 10 are disposed with their front sides facing an audience. Audio signals generated in response to a performance on the electronic keyboard musical instrument KB are mixed by the mixer apparatus 13, and signals of two, i.e., left and right, channels, are supplied to respective ones of the speaker devices 10 for sounding or audible reproduction. Constructions for attaching the left and right speaker devices 10 to the respective distal ends of the poles 12 are generally identical to each other, and thus, the following description will be given without distinguishing between the left and the right unless it is necessary to particularly distinguish between the left and the right. Further, in the following description, let it be assumed that the side of the speaker device 10 facing the audience is referred to as a "front side", that left and right directions are directions as viewed from a human player or user of the electronic keyboard musical instrument KB, and that a vertical or up-right direction is a direction in which the pole 12 projects upwardly from the stand 11 with the speaker device 10 attached to the distal end of the pole 12.

FIG. 1(*b*) is a front perspective view of a lower portion of a casing 14 of the speaker device 10 with a front cover removed. The speaker device 10 includes the casing 14 formed for example of resin and the front cover 9 (FIG. 1 (*a*)) secured to the casing 14. A mounting mechanism section M is provided beneath an upwardly protruding portion of a bottom plate 15 of the casing 14. The mounting mechanism section M includes, among other things, a later-described insertion hole section 20 and a lever-disposed portion 30.

The casing 14 includes a mounting boss 17 and a rib 18 formed integrally with the mounting mechanism section M. The rib 18 also functions to reinforce the mounting bass 17 (see also FIG. 4). Further, mounting bosses 19 are formed integrally on left and right wall portions of the casing 14. The mounting bosses 17 and 19 are threaded mounting portions to which the above-mentioned front cover 9 is threadedly fixed.

Figure 2:
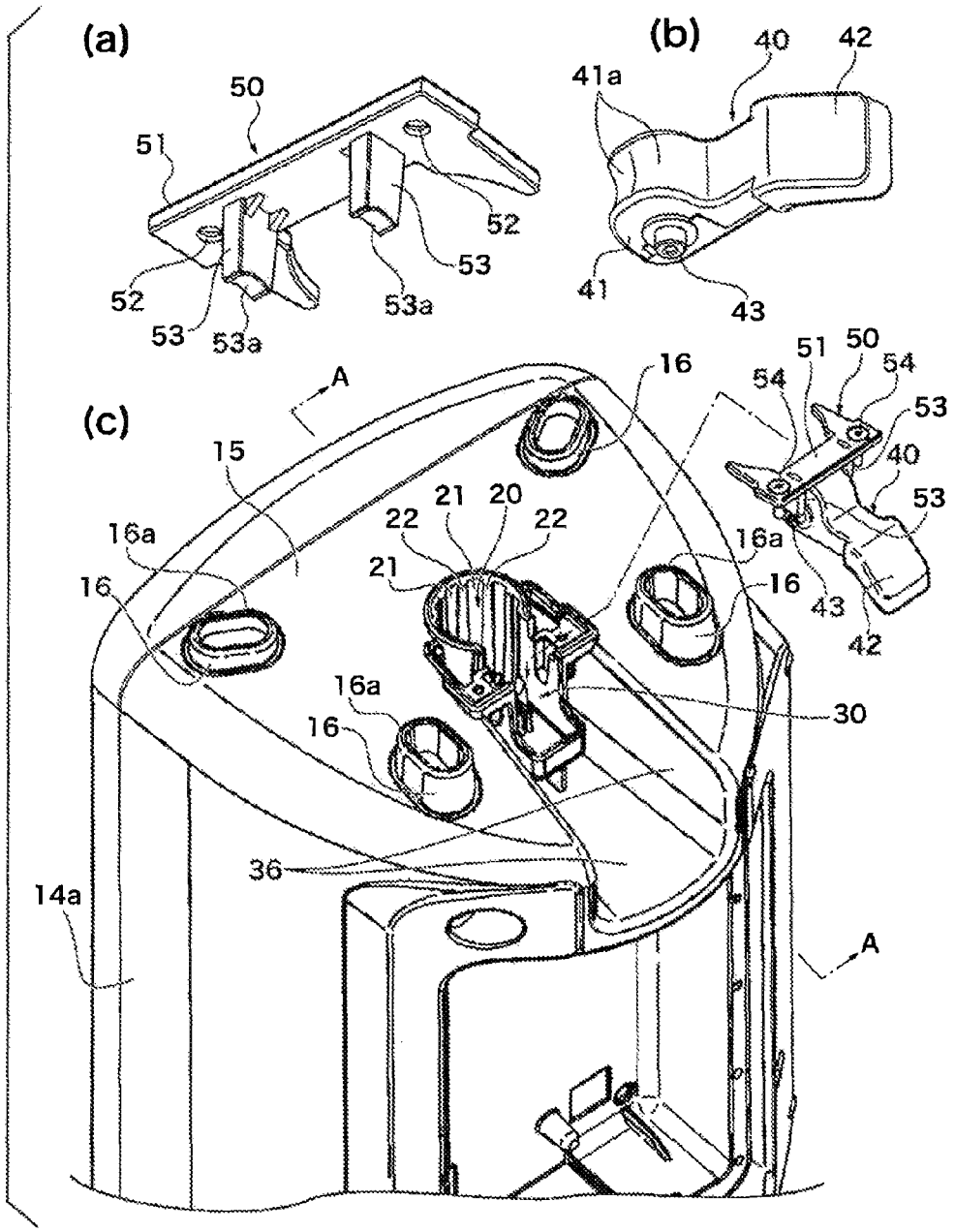
FIGS. 2(*a*) and (*b*) are perspective views, respectively, of a support cover constituting a part of the mounting mechanism section and a lever that is a pressing member, and FIG. 2(*c*) is a lower perspective view showing the speaker device together with a support cover and a lever for the speaker device.

FIGS. 2 (*a*) and (*b*) are perspective views, respectively, of a support cover constituting a part of the mounting mechanism section M and a lever that is a pressing member. Further, FIG. 2 (*c*) is a lower perspective view showing the speaker device 10 together with the support cover 50 and the lever 40.

As shown in FIG. 2 (*c*), the bottom plate 15 has leg portions 16 projecting from four positions of the bottom plate 15. Although the bottom plate 15 extends obliquely, the distal ends 16*a* that are leg bottoms of the four leg portions 16*a* are formed to be located in a same horizontal plane such that the side surface 14*a* of the casing 14 extends vertically to the horizontal. Further, the insertion hole section 20 and the lever-disposing section 30 communicating with each other are formed in a central region of the bottom plate 15, integrally with the bottom plate 15, as parts of the mounting mechanism M. The lever-disposing section 30 has an accommodating recessed portion 36 for accommodating therein the lever 40 in a loosened position. The support cover 50 and the lever 40 are disposed in the lever-disposing section 30.

As shown in FIG. 2(*b*), the lever 40 has an operating portion 42 extending from a head section 41 thereof. Two pivot shafts 43 project from opposite side surfaces of the head section 41 away from each other (only one such pivot shaft 43 projecting from one of the opposite side surfaces is shown). The outer peripheral surface of the head section 41 functions as a pressing surface 41*a* that presses an outer peripheral side surface portion of the pole 12 of the stand 11. The pressing surface 41*a* has a cam shape that is substantially circular in a rotating direction of the pivot shafts 43 (as will be later described more specifically) and that is concavely curved like a so-called "saddle shape" with respect to an axial direction of the pivot shafts 43. When the lever 40 is in a tightened position of the lever 40, the concave curvature allows the pressing surface 41*a* to be placed in close pressed contact with a wider outer peripheral side portion of the pole 12 and thereby contributes to enhanced fixation force.

As shown in FIG. 2(*a*), the support cover 50 includes a plate section 51 which has two fastening holes 52 formed therein and two projections 53 projecting therefrom. The distal end of each of the projections 53 is formed as a concavely curved surface 53*a* performing a part of a function for pivotally supporting the pivot shaft 43.

Figure 3:
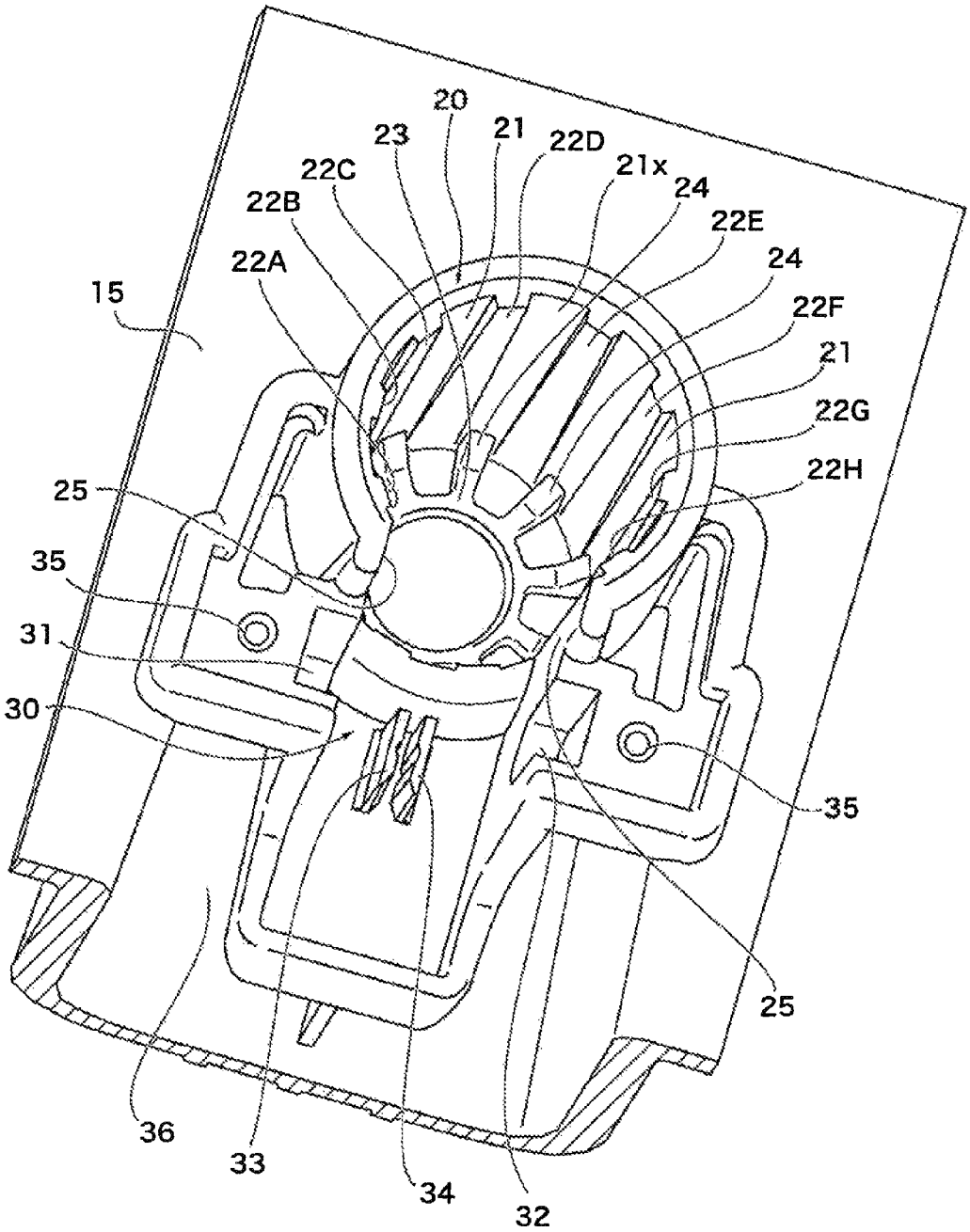
FIG. 3 is an enlarged perspective view of an insertion hole section and a lever-disposing section.
Figure 4:
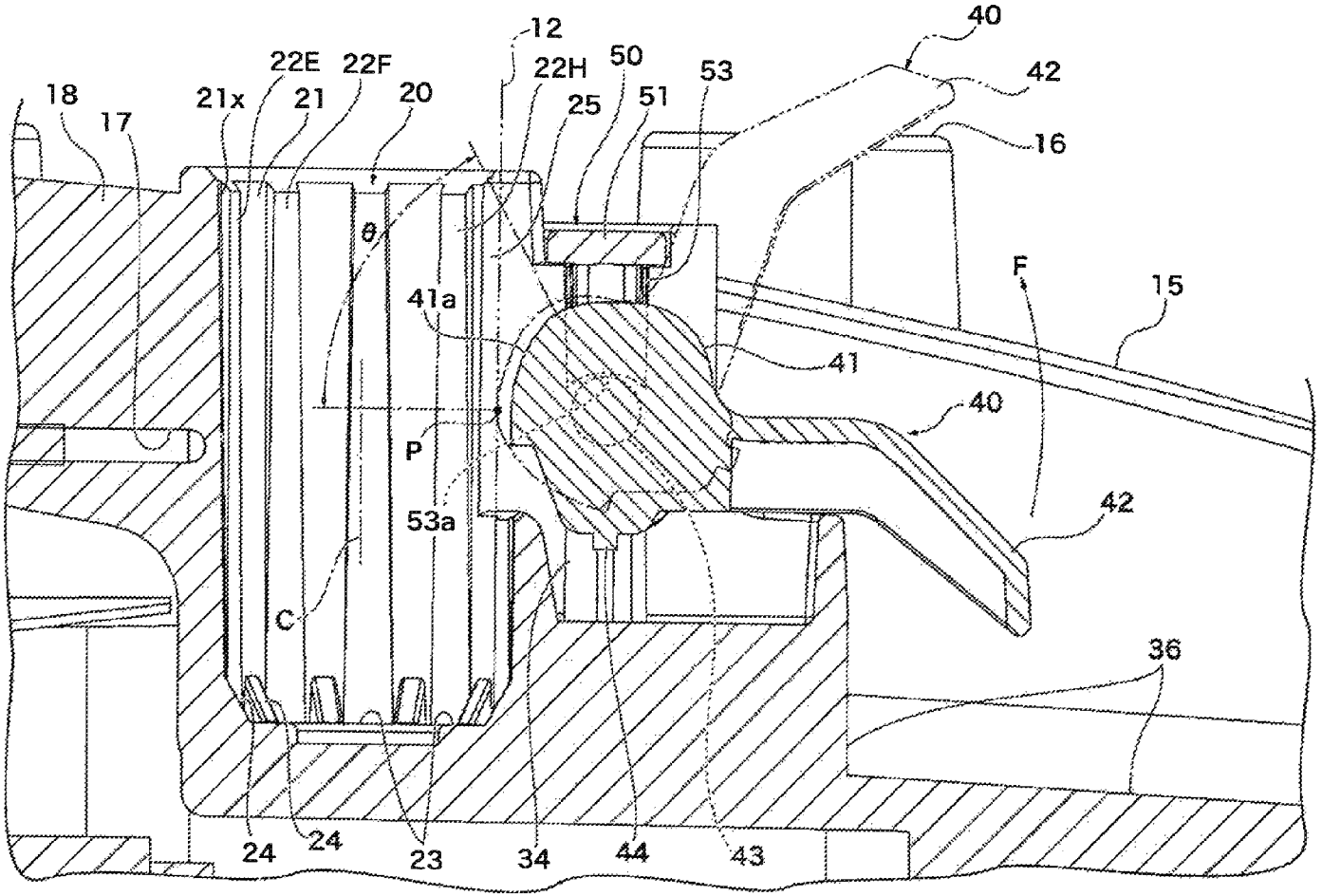
FIG. 4 is a sectional view taken along the A-A line of FIG. 2(*c*)

FIG. 3 is an enlarged perspective view of the insertion hole section 20 and the lever-disposing section 30. FIG. 4 is a sectional view taken along the A-A line of FIG. 2(*c*), which particularly shows a sectional surface passing centrally through the insertion hole section 20 and parallel to an up-down direction and a front-rear direction. In FIG. 4, the speaker device 10 is shown upside down.

As shown in FIGS. 3 and 4, an axis centerline C (FIG. 4) of the stand's pole 12 extends parallel to the vertical direction. The insertion hole section 20 has an inner diameter slightly greater than the maximum outer thickness of the pole 12 inserted in the insertion hole section 20. More specifically, furrow portions 21 and ridge portions 22 are formed alternately on the circumferential surface of the insertion hole section 20, so that the inner surface of the ridge portions 22 defines a substantive inner diameter of the insertion hole section 20. A recessed portion 25 is formed in a part of the insertion hole section 20. Further, the insertion hole section 20 has a flat bottom surface 23 formed on its bottom. Tapering surfaces 24 are formed integrally with the flat bottom surface 23 and the recessed portion 25.

Eight ridge portions 22 are formed at intervals in the circumferential direction on a region of the inner circumferential surface where the recessed portion 25 is not formed. Whereas ridge portions similar to the ridge portions 22 are formed upward (downward in FIG. 4) of the recessed portion 25, they may be dispensed with. The furrow portions 21 (particularly the furrow portion 21*x*) are located on the sectional surface along the A-A line of FIG. 2 across the centerline C from the recessed portion 25.

The lever-disposing section 30 is located rearward of the insertion hole section 20 adjacent to the recessed portion 25. As shown in FIG. 3, the lever-disposing section 30 has U-shaped recesses 31 and 32 in which the pivot shafts 43 of the lever 40 are fitted. Fastening threaded holes 35 are formed in the U-shaped recesses 31 and 32. A pair of retaining sections 33 and 34, each in the form of a projection, is provided rearward of the insertion hole section 20. Further, as shown in FIG. 4, a projecting pin 44 of a circular sectional shape is formed integrally on the head section 41 of the lever 40, and the retaining sections 33 and 34 can sandwich therebetween the projecting pin 44. Concavely curved surfaces corresponding in shape to the projecting pin 44 are formed on mutually-opposed surfaces of the retaining sections 33 and 34.

The lever 40 and the support cover 50 are assembled to the speaker device 10 at a stage before the speaker device 10 is attached to the pole 12. The lever 40 and the support cover 50 are disposed on the lever-disposing section 30 in the following manner. If, at that time, the speaker 10 is placed upside down to expose the lower surface of the bottom plate 15 upwardly, operations for disposing the lever 40 and the support cover 50 on the lever-disposing section 30 can be performed with ease.

First, the two pivot shafts 43 of the lever 40 are inserted into the U-shaped recesses 31 and 32, at which time the projecting pin 44 of the lever 40 is retained between the retaining sections 33 and 34. Then, the support cover 50 is put on the lever 40 in such a manner that the concavely curved surface 53*a* at the distal end of each of the projections 53 of the support cover 50 is opposed to a corresponding one of the pivot shafts 43 (see FIG. 2(*c*) and FIG. 4). Then, screws 54 (FIG. 2(*c*)) are screwed, through the two fastening holes 52 of the support cover 50, into the threaded holes 35 (FIG. 3).

In the aforementioned manner, the lever 40 and the support cover 50 are fixed to the lever-disposing section 30 of the bottom plate 15. Further, the two pivot shafts 43 of the lever 40 are sandwiched between the concavely curved surfaces 53*a* of the projections 53 and the U-shaped recesses 31 and 32 and pivotably supported by the concavely curved surfaces 53*a* and curved surface portions of the U-shaped recesses 31 and 32. In this way, the lever 40 is pivotable about the pivot shafts 43 (FIG. 4). Note, however, that the lever 40 is retained at a particular pivotal position while the projecting pin 44 is kept sandwiched between the retaining sections 33 and 34. The pressing surface 41*a* of the head section 41 of the lever 40 faces the interior of the insertion hole section 20 through the recessed portion 25 of the insertion hole section 20 (FIG. 4). The head section 41 of the lever 40 constitutes a cam where a distance from the pivot center of a portion of the pressing surface 41*a* opposed to the pole 12 in the tightened position to the outer peripheral edge of the head section 41 (i.e., large diameter portion) is greater than a distance from the pivot center of a portion of the pressing surface 41*a* opposed to the pole 12 in the loosened position to the outer peripheral edge of the head section 41 (i.e., small diameter portion).

The lever 40 indicated by solid line in FIG. 4 is in the loosened position where the projecting pin 44 is sandwiched between the retaining sections 33 and 34 (i.e., where the small diameter portion of the head section 41 of the lever 40 is opposed to the pole 12). Namely, the lever 40 can be tightened or loosened by being pivoted in response to a user operating the operating portion 42 with his or her hand. By the lever 40 being pivoted from the loosened position in a tightening direction F (i.e., counterclockwise direction of FIG. 4) to an end of a pivotable range, the lever 40 is brought to the tightened position as indicated by imaginary line (i.e., where the large diameter portion of the head section 41 of the lever 40 is opposed to the pole 12 and the pressing surface 41*a* is brought into close pressed contact with the pole 12). Because the central axis of each of the pivot shafts 43 extends vertically to, or in a direction intersecting substantially perpendicularly with, the axis line of the insertion hole section 20, a direction in which the lever 40 pivots is the axial direction of the pole 12, i.e. the up-down direction. With such arrangements, the lever 40 can press against the pole 12 in an appropriate manner.

In the loosened position, the lever 40 is located in its entirety above the lower surface of the bottom plate 15 (as indicated by solid line of FIG. 4) and accommodated in the accommodating recessed portion 36. Further, because the pivoting movement of the lever 40 is suppressed or limited by the retaining sections 33 and 34, the lever 40 would neither wobble nor project outward when the speaker device 10 is handled as a single unit, and particularly when the speaker device 10 is placed on a floor surface.

Normally, to mount the speaker device 10, having the lever 40 and the support cover 50 assembled thereto, on the stand 11, the speaker device 10 is oriented in its right up-down direction, and then the distal end of the pole 12 of the stand 11 is inserted into the insertion hole section 20. Because the pole 12 is provisionally fitted in the inner diameter defined by the plurality of ridge portions 22 of the insertion hole section 20, the lever 40 can be kept inserted in the insertion hole section 20 even when the lever 40 is in the loosened position.

As the pole 12 is inserted into the insertion hole section 20, the distal end of the pole 12 is brought into abutment with the bottom surface 23 of the insertion hole section 20 while being automatically centered appropriately by the tapering surfaces 24. However, if the hole 12 has a great diameter, the distal end of the pole 12 is kept abutted against the tapering surfaces 24. Namely, the bottom surface 23 or the tapering surfaces 24 functions as an abutting section which the distal end of the pole 12 abuts against. After that, the user pivots the lever 40 by operating the operating portion 42 in the tightening direction F.

Here, as shown in FIG. 4, the pressing surface 41*a* of the head section 41 of the lever 40 is constructed such that the distance from the central axis of the pivot shaft 43 to the pressing surface 41*a* (i.e., contour of the pressing surface 41*a*) gradually varies over an angular region θ. Of such a pressing surface 41*a*, a portion projecting most toward the central axis C of the pole 12 presses an outer peripheral side surface portion of the pole 12. Such a portion projecting most toward the central axis C will hereinafter be referred to as a "pressing position P". In the angular region θ, the pressing position P gradually gets closer to, or approaches, the central axis C as the lever 40 is pivoted in the tightening direction F; thus, pressing force applied from the pressing surface 41*a* to the pole 12 increases as the lever 40 is pivoted in the tightening direction F.

In the tightening direction F, the pivotable range of the lever 40 is greater than the angular region θ, and the pressing surface 41*a* has a constant contour in a region exceeding the angular region θ in the counterclockwise direction of FIG. 4. Thus, even when the user has tightened the lever 40 beyond the angular region θ, the pressing position P remains unchanged so that the pole 12 continues to be pressed by the pressing surface 41*a* with a constant pressing force.

The pole 12 pressed forward by the pressing surface 41*a* is engaged mainly by the ridge portions 22C to 22F (FIG. 3), located across the central axis C from the pressing surface 41*a*, of the plurality of ridge portions 22. What functions most as a "stopping/engaging section" for stopping and engaging the pole 12 is the ridge portions 22D and 22E located to the left and right of the furrow portion 21*x*, because the ridge portions 22D and 22E are located not only on opposite sides of the sectional surface along the A-A line as viewed in the axial direction of the pole 12 but also closest to an opposed portion of the pressing surface 41*a*.

Further, a function as a "provisional engaging section" that surrounds the pole 12, inserted in the insertion hole section 20, in conjunction with the aforementioned "stopping/engaging section" and keeps the pole 12 inserted in the insertion hole section 20 even in the loosened position of the lever 40 is performed mainly by the ridge portions 22A and 22H. This is because the ridge portions 22A and 22H are located closer to the pressing surface 41*a* of the lever 40 than the stopping/engaging section in a circumferential direction around the central axis C. The provision of such a provisional engaging section allows a pole attaching operation to be performed with an increased operability.

Namely, mounting, on the stand 11, of the speaker device 10 can be completed by the user inserting the pole 12 into the insertion hole portion 20 and pivoting the lever 40 downward. Further, to dismount the speaker device 10 from the stand 11, the user only has to pivot the lever 40 upward. Besides, the upward-pivoted lever 40 is prevented from swaying, by the projecting pin 44 being kept sandwichingly retained between the retaining sections 33 and 34. Thus, attachment and detachment of the pole 12 to and from the speaker device 10 can be performed with an increased operability.

According to the instant embodiment, as noted above, the pressing position P, which presses an outer peripheral side surface portion of the pole 12, gradually gets closer to the central axis C so that pressing force applied from the pressing surface 41*a* to the pole 12 increases as the lever 40 is pivoted in the tightening direction F. In this way, the operations for mounting the speaker device 10 to the pole 12 of the stand 11 can be facilitated. Further, because the position of the pressing surface 41*a* becomes constant halfway through the pivoting movement in the tightening direction, the pressing force applied from the lever 40 can be made constant at a final stage of the tightening, so that the speaker device 10 can be fixed in a stable manner.

Further, because not only the pressing surface 41*a* of the head section 41 of the lever 40 faces the interior of the insertion hole section 20 through the recessed portion 25 of the insertion hole section 20 as noted above but also the inner surfaces (particularly, the ridge portions 22) of the insertion hole section 20 functions as the stopping/engaging section and the provisional engaging section, the speaker device 10 can be provisionally attached to the pole 12 in a stable manner, so that the operations for mounting the speaker device 10 to the pole 12 of the stand 11 can be even further facilitated but also the construction for mounting the speaker device 10 to the pole 12 of the stand 11 can be significantly simplified. Furthermore, the provision of the retaining sections 33 and 34 can prevent swaying or wobbling of the lever 40 in the loosened position.

Note that, as long as the pole 12 inserted in the insertion hole 20 can be pressed by the lever (pressing member) 40 from a lateral side, the pivoting direction of the lever (pressing member) 40 is not limited to the up-down direction as in the above-described embodiment. Namely, the pivot shafts 43 of the lever (pressing member) 40 need not necessarily extend vertically to, or in a direction intersecting substantially perpendicularly with, the axial direction of the pole 12 and may be disposed in any other desired fashion.

Further, the lever 40 may be locked in the loosened position by other than the aforementioned mechanism comprising the projecting pin 44 and the retaining sections 33 and 34, such as a locking mechanism constructed to prevent the lever 40 from pivoting in the tightening direction F by its own weight. Alternatively, a coil spring that applied small biasing force may be attached to the rotation shafts 43 so that the lever 40 is normally biased in the loosening direction.

Note that, whereas the support cover 50 and the lever 40 have been described above as constructed as separate members and assembled to the bottom plate 15, the support cover 50 and the lever 40 may be constructed as an integral one-piece member and then assembled to the bottom plate 15. Furthermore, a mechanism for pivotably supporting the rotation shafts 43 may be provided on the bottom plate 15 rather than a separate support member, such as the support cover 50.

The instant embodiment has been described above as constructed in such a manner that the speaker device 10 is fixed by the pole 12 being inserted in the hole-shaped element, i.e. the insertion hole section 20. However, for the purpose of simplifying the fixing, to the pole 12, of the speaker device 10, the mounting mechanism section M may be modified into another construction that is not in the form of a hole as exemplarily shown in FIG. 5.

Figure 5:
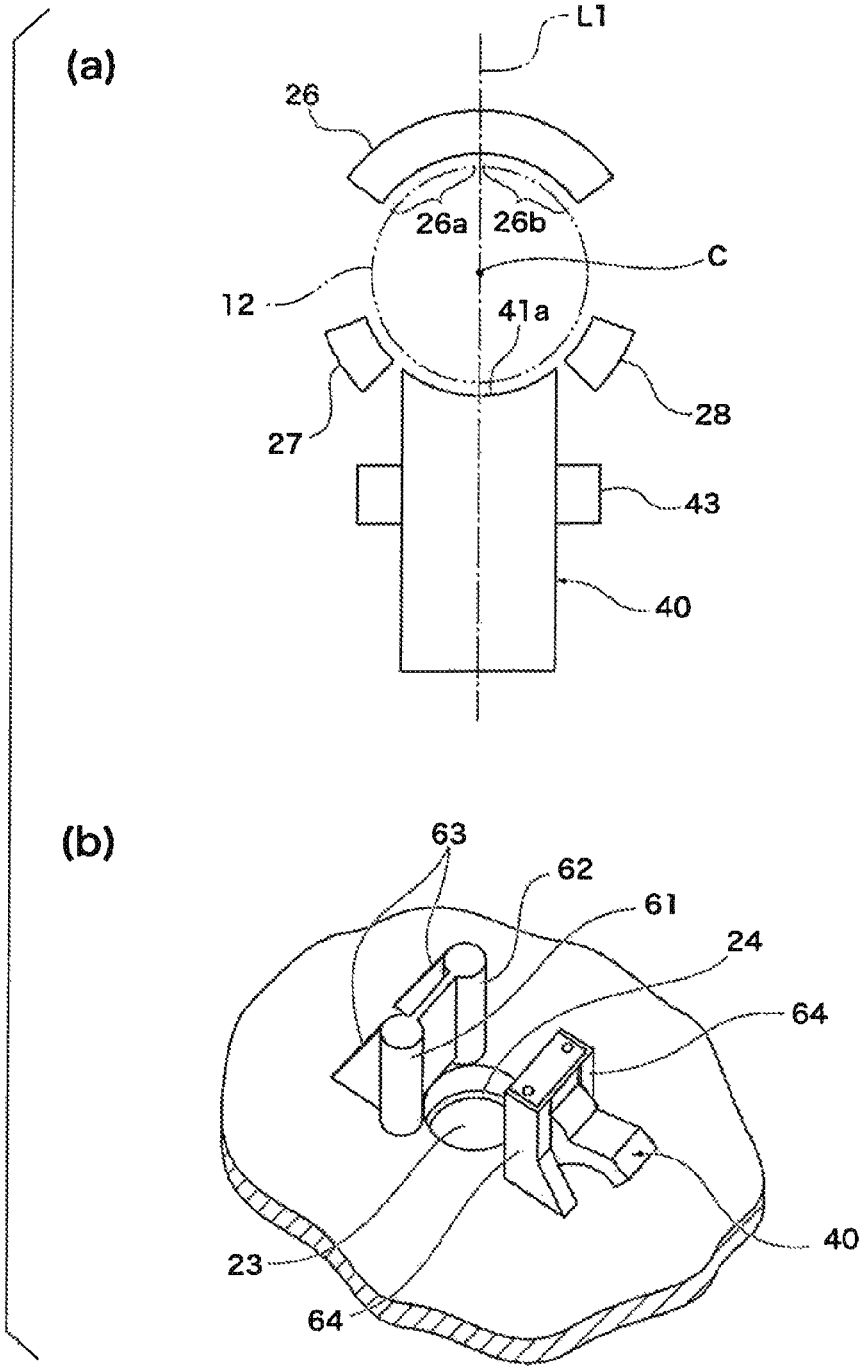
FIGS. 5(*a*) and 5(*b*) are schematic views of a modified mounting mechanism section.

FIG. 5(*a*) is a schematic view of the modified mounting mechanism section M as viewed in the axial direction of the central axis C. As shown in FIG. 5(*a*), an arcuate (arc-shaped) engaging section 26 is provided across the central axis C from the lever's pressing surface 41*a*. Also, provisional engaging sections 27 and 28 are provided close to the pressing surface 41*a*. Each of the arcuate engaging section 26 and provisional engaging sections 27 and 28 has a furrow portion corresponding in shape to the contour of the pole 12, similarly to the above-mentioned ridge portion 22. The modified mounting mechanism section M further includes an abutting section that corresponds to the bottom surface 23 or the tapering surfaces 24.

With the pole 12 abutted against the abutting section, the pole 12 is surrounded by the arcuate engaging section 26 and provisional engaging sections 27 and 28, so that the speaker device 10 can be provisionally attached to the pole 12 in a stable manner. As the lever 40 is tightened, the pressing surface 41*a* presses a portion of the pole 12, so that a portion of the pole 12 opposite from the pole's pressed portion is engaged and fixed by the arcuate engaging section 26.

From such a perspective, it just suffices that the "stopping/engaging section" be provided across the central axis C from the pressing surface 41*a* and engage the pole 12 at least two portions thereof that are located on opposite sides of an imaginary straight line L1 passing through the pressing surface 41*a* and the central axis L1 as viewed in the axial direction of the pole 12. In the illustrated example of FIG. 5(*a*), first and second regions 26*a* and 26*b* of the arcuate engaging section 26 correspond to such at least two portions of the pole 12. Note, however, that such at least two portions need not be the entire first and second regions 26*a* and 26*b* and may be partial regions of the arcuate engaging section 26, such as regions near the opposite ends of the arcuate engaging section 26. Note that, in the illustrated examples of FIGS. 2 to 4, an imaginary straight line as the sectional surface along the A-A line is viewed in the axial direction of the pole 12 corresponds to the imaginary straight line L1.

Further, the "provisional engaging section" may be of any desired construction as long as it is provided at a position closer to the pressing surface 41*a* than the "stopping/engaging section" in the circumferential direction around the central axis C and can surround the pole 12 in conjunction with the stopping/engaging section when the lever 40 is in the loosened position.

FIG. 5(*b*) is a perspective view of another modification of the modified mounting mechanism section M. In the illustrated example of FIG. 5(*b*), two engaging portions 61 and 63, each having a circular columnar shape, project as the stopping/engaging section, and these circular columnar engaging portions 61 and 63 are reinforced by triangular ribs 63. The lever 40 is pivotably supported by a support section 64. If stability of the attachment of the speaker device 10 to the pole 12 is not required, such a "provisional engaging section" need not necessarily be provided. Also note that a surface of the support section 64 opposed to the pole 12 may be shaped in such a manner as to be capable of performing the function of the aforementioned provisional engaging section 64.

Further, whereas the pole 12 of the stand 11 in the instant embodiment has been described as being of a circular columnar shape, it may be in the form of a polygonal column of a cross sectional shape having four or more sides.

Although the present invention has been described above in relation to preferred embodiments, the present invention is not limited to these particular embodiments and should be construed as embracing various other forms without departing from the gist of the invention.

The invention claimed is:

1. An audio device detachably attachable to a pole of a stand, comprising:

an abutting section constructed in such a manner that a distal end of the pole abuts against said abutting section when said audio device is attached to the pole;

a pressing member constructed to be operable to pivot in tightening and loosening directions, said pressing member having a pressing surface that presses a side surface portion of the pole toward a central axis of the pole as said pressing member is operated to pivot in the tightening direction with said audio device attached to the pole; and a stopping/engaging section provided opposite from the pressing surface of said pressing member across the central axis, said stopping/engaging section engaging and supporting the pole pressed by the pressing surface, wherein said pressing member is constructed in such a manner that, as said pressing member is operated to pivot in the tightening direction, a position of the pressing surface pressing a side surface portion of the pole gradually gets closer to the central axis of the pole so that pressing force applied from the pressing surface increases.

2. The audio device as claimed in claim 1, wherein said stopping/engaging section is constructed to engage the pole, pressed by the pressing surface, at least two portions thereof that are located on opposite sides of an imaginary straight line passing through the pressing surface and the central axis.

3. The audio device as claimed in claim 1, which further comprises a provisional engaging section that is provided at a position closer to the pressing surface than the stopping/engaging section and along a circumferential direction around the central axis of the pole and that surrounds, in conjunction with the stopping/engaging section, the pole that is in abutting engagement with the abutting section when said pressing section is in a loosened position.

4. The audio device as claimed in claim 3, which further comprises an insertion hole section which the pole is insertable therein and has said abutting section provided on a bottom thereof, and wherein said pressing surface faces an interior of the insertion hole section through a recessed portion formed in a part of the insertion hole section, but also an inner surface of the insertion hole section is constructed to function as the stopping/engaging section and the provisional engaging section.

5. The audio device as claimed in claim 4, wherein the inner surface of the insertion hole section has a ridge portion and a furrow portion arranged in the circumferential direction, the ridge portion functioning as the stopping/engaging section and the provisional engaging section.

6. The audio device as claimed in claim 1, wherein said pressing surface is constructed in such a manner that the position of the pressing surface, pressing the side surface portion of the pole, becomes constant halfway through pivoting movement, in the tightening direction, of said pressing member.

7. The audio device as claimed in claim 1, wherein a pivot shaft of said pressing member extends vertically to an axial direction of the pole.

8. The audio device as claimed in 7, wherein said pressing member has an operating portion disposed on a bottom portion of said audio device and adapted for operation by a user, and wherein a retaining section is provided on the bottom portion and adapted to retain the operating portion when said pressing member is in a loosened position.

9. The audio device as claimed in claim 7, wherein said pressing surface has a concavely curved portion.

* * * * *